US005669164A

United States Patent [19]

Voitchovsky

[11] Patent Number: 5,669,164

[45] Date of Patent: Sep. 23, 1997

[54] DOMESTIC IRONING EQUIPMENT INCLUDING PRESSURE PRODUCING IRONING BOARD

[75] Inventor: Serge Georges Voitchovsky, Mezieres, Switzerland

[73] Assignee: Divelit S.A., Switzerland

[21] Appl. No.: 660,064

[22] Filed: Jun. 3, 1996

[30] Foreign Application Priority Data

Jun. 19, 1995 [CH] Switzerland ..... 1792/95

[51] Int. Cl.[6] ..... D06F 81/00

[52] U.S. Cl. ..... 38/137

[58] Field of Search ..... 38/104, 102, 103, 38/137, 140, 79; 219/245, 246, 247, 250, 254, 258; 126/33; 68/222

[56] References Cited

U.S. PATENT DOCUMENTS 2,495,468 1/1950 Mueller .

FOREIGN PATENT DOCUMENTS

| | | | |
|---|---|---|---|
| 0531207 | 3/1993 | European Pat. Off. | 38/137 |
| 3051091 | 3/1991 | Japan | 38/137 |
| 1 519 356 | 7/1978 | United Kingdom . | |
| 2226830 | 7/1990 | United Kingdom | 38/137 |
| 1009170 | 6/1991 | WIPO | 38/137 |

OTHER PUBLICATIONS

DE,U,89 14 772 (N.V. Philips Gleoilampenfabrieken) Feb. 15, 1990 voir p. 1, ligne 1–ligne 15; FIG. 1.

*Primary Examiner*—Ismael Izaguirre

*Attorney, Agent, or Firm*—Kane, Dalsimer, Sullivan, Kurucz, Levy, Eisele and Richard, LLP

[57] ABSTRACT

It consists of a perforated board (1), mounted on a folding support (2). It is fitted with a ventilator (3) that is linked to a chamber located under the board (1), and fitted so that the ventilator can run in one direction of rotation or another in order to generating negative or positive pressure in the chamber. The steam iron (4), supplied by a flexible cable (5), is equipped with a control that regulates the steam and the operation of the ventilator.

4 Claims, 1 Drawing Sheet

DOMESTIC IRONING EQUIPMENT INCLUDING PRESSURE PRODUCING IRONING BOARD

FIELD OF THE INVENTION

This invention involves domestic ironing equipment consisting of an ironing board which has below its upper surface (which is perforated) a chamber connected to a generator of negative pressure and a generator of positive pressure, including a steam iron which is equipped with a steam control.

PRIOR ART

It is a well-known fact that current domestic ironing equipment use steam irons. The steam is produced either by a heating element which is integrated into the body of the iron, or by a heating element which is not part of the iron but part of the ironing board or by a heating element which is completely independent of the ironing equipment.

Equally well-known are professional ironing installations, which consist of an ironing table whose upper surface is perforated and to which a chamber is connected, which is also connected to means of generating positive or negative pressure, as required. These means are often turbines which are operated by controls consisting of pedals that the user activates when required.

The advantage of having at one's disposal a source of negative pressure, i.e. a sucking action, when carrying out ironing with a steam iron, is that the garment dries more quickly. Positive pressure, i.e. a blowing action, on the other hand, is used to inflate the garment and avoid incorrect creases.

Until now, this type of equipment that includes both sucking and blowing has only been used by professionals.

It has proven to be the case that domestic ironing installations consisting of steam irons, which have proved very popular in recent years, could be improved by the additional provision of equipment that would make sucking and blowing functions available to users.

For domestic installations of this type, the cost must be reasonable, in order to ensure commercial success. Professional installations often have either separate turbines, one for blowing and one for sucking, or else they have electromechanical arrangements for connecting the chamber on the ironing table upstream or downstream from the flow of the turbine used. Arrangements of this kind are too expensive and bulky for a domestic product.

SUMMARY OF THE INVENTION

The aim of this invention is to make available a domestic steam ironing installation that is relatively cheap, and easy to manufacture and maintain. For this reason, the equipment described in this invention is characterised by the fact that the means of generating negative and positive pressure consist of one simple axial flow ventilator and arrangements for selecting the direction of rotation and controlling the ventilator in order to generate positive and negative pressure.

The advantages of the equipment described in this invention are the fact that the blowing and sucking functions are provided by one simple axial flow ventilator controlled by an electronic control that can be used to invert the direction of rotation of the ventilator. The fact that an axial ventilator is used is important because it makes it possible to achieve equal power levels in both directions of rotation, by inverting the direction of rotation of the ventilator.

In a preferred variant of the invention, the instrument used to control the steam is also used to control the ventilator via an electronic circuit, which also makes the equipment easier to use.

In another product variant of the invention, the direction of rotation of the ventilator is determined in accordance with the manual pressure exerted on the button that controls the steam. If, for example, the user exerts a manual pressure for more than a pre-defined period, the ventilator runs in the direction that produces a sucking action. If the manual pressure is exerted for less than a pre-defined period, the ventilator runs in the direction that produces a blowing action. Usually, the period $t_0$ is around a half-second.

In another product variant of the invention, the functioning of the ventilator is prolonged by a timer circuit for a period $t_1$ after the final pressing of the control that regulates the steam.

This means that if the control that regulates the steam is not pressed during a period that is longer than $t_1$, for example 3 or 4 seconds, the ventilator is shut down. Every time the control that regulates the steam is pressed again, whether for a short or long time (a period of $t_2$), after the initial pressing that has determined the direction of rotation of the ventilator, however long it was pressed for, the ventilator runs in the same direction as was initially selected.

The iron used in this equipment is a steam iron whose heating element is either an integral part of the body of the iron, or it is an independent heater which is or is not an integral part of the ironing board.

BRIEF DESCRIPTION OF THE DRAWINGS

The invention shall be described in more detail with the help of the appended drawing.

DESCRIPTION OF THE PREFERRED EMBODIMENT

Figure 1:
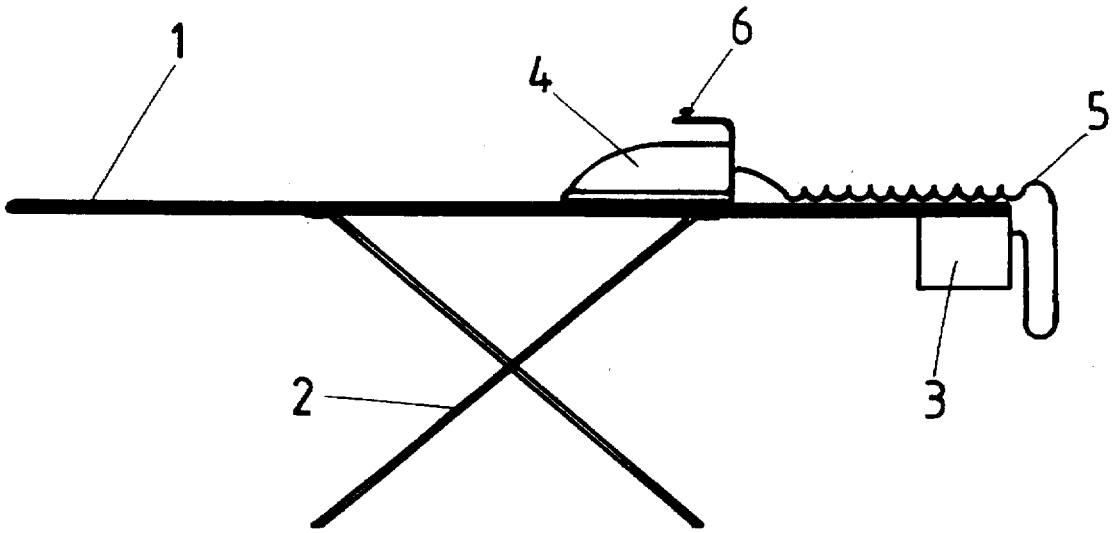
FIG. 1 is a schematic view of an installation showing the principal elements.

The equipment consists of a board 1 mounted on a folding support 2 fitted with a ventilator 3 that is directly linked to the chamber located under the table 1, a steam iron 4 supplied by a flexible power cable 5 which provides the iron with electrical power, the ventilator control 3 and, where appropriate, the steam arrival point, if the heater is not an integral part of the iron 4. The entire unit is of course connected to a domestic power supply point.

Figure 2:
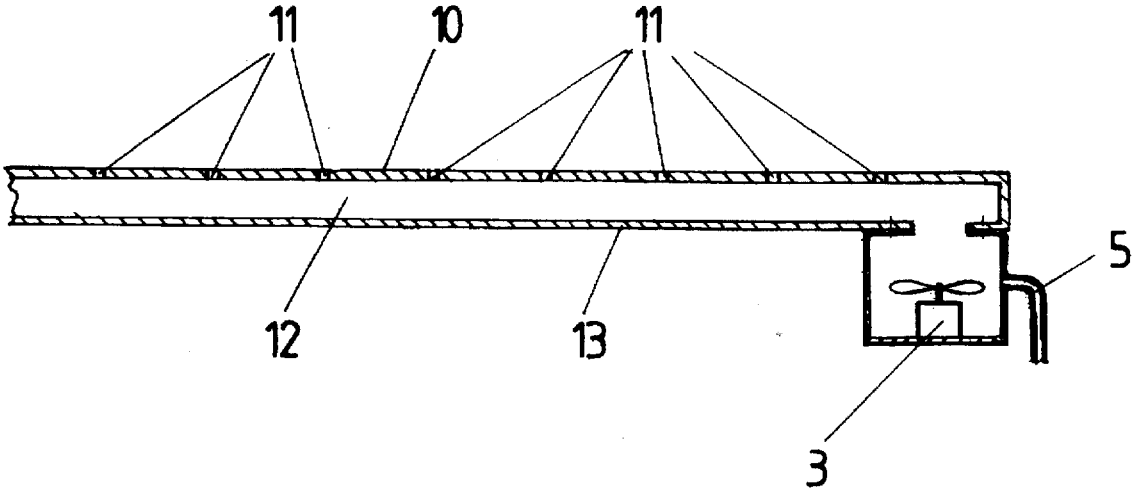
FIG. 2 is a longitudinal cross-section of the ironing board.

In FIG. 2, we have shown a cross-section of the table with an upper surface 10 with perforations 11 leading to a chamber 12 which is closed and connected to the ventilator 3 attached to the lower surface 13 of the chamber 12.

The ventilator is controlled by the control 6 that regulates the steam for the iron 4. The ventilator control 3 is equipped with an electronic circuit which uses a suitable logic circuit to control the direction of rotation of the ventilator in accordance with the following criteria:

If the user presses on the control 6 for a period that is longer than $t_0$, which may be a maximum, for example, of half a second, the ventilator operates in the direction that produces a sucking action. If the user presses on the control 6 for a period that is shorter than $t_0$ the ventilator operates in the direction that produces a blowing action. In addition, a timer circuit is provided that activates the ventilator during a pre-determined period $t_1$ of around 3 or 4 seconds, after the last time the control is pressed. This control is arranged in such a way that whenever the user presses the control 6, during the period $t_1$, after the first time which determines the direction of rotation of the ventilator, this prolongs the action of the ventilator which continues to operate in the selected direction of rotation, regardless of how long the user presses the control.

Obviously, the ventilator could be moved to another location on the ironing board and then be connected to the chamber 12 by a flexible coupling.

Similarly, different types of steam iron could be used, such as an iron with an integral heater or a separate heater which may or may not be integrated with the ironing table.

I claim:

1. Domestic ironing equipment comprising an ironing board, underneath whose perforated upper surface there is a chamber connected to means of generating negative and positive pressure, and including a steam iron equipped with a steam control, characterised by the fact that the means of generating negative and positive pressure comprises one simple axial flow ventilator and arrangements for selecting the direction of rotation and controlling the ventilator in order to generate positive and negative pressure, the means of controlling the ventilator comprising an electronic circuit that controls the ventilator's power supply, the electronic circuit being controlled by the steam control, the electronic circuit that controls the ventilator being arranged in such a way that the ventilator rotates in the direction required to produce a negative pressure if the user exerts a manual pressure for more than a pre-defined period $t_0$, if the manual pressure is exerted for less than the pre-defined period $t_0$, the ventilator rotates in the direction that produces positive pressure.

2. Domestic ironing equipment in accordance with claim 1, characterised by the fact that the electronic circuit that controls the ventilator is equipped with a timer circuit that activates the ventilator during a pre-determined period $t_1$, after the last time the manual pressure is exerted.

3. Domestic ironing equipment in accordance with claim 1, characterised by the fact that the iron has an integral heating element, which forms part of its body.

4. Domestic ironing equipment in accordance with claim 3, characterised by the fact that the heating element supplies the iron with steam and is an integral part of the equipment.

* * * * *